United States Patent [19]

Bright et al.

[11] Patent Number: 5,037,499

[45] Date of Patent: Aug. 6, 1991

[54] LABELING MACHINE COMBINING A TURRET AND A VACUUM DRUM-ROLL ON PAD

[75] Inventors: Lyn E. Bright, Ceres; Hugh E. Cummins, Turlock, both of Calif.

[73] Assignee: B & H Manufacturing Company, Inc., Ceres, Calif.

[21] Appl. No.: 443,120

[22] Filed: Nov. 29, 1989

[51] Int. Cl.[5] ..... B65C 3/16; B65C 9/04

[52] U.S. Cl. ..... 156/456; 156/567; 156/568; 156/DIG. 13; 156/DIG. 26

[58] Field of Search ..... 156/456, 567, 568, DIG. 13, 156/326

[56] References Cited

U.S. PATENT DOCUMENTS 4,108,709 8/1978 Hoffmann ..... 156/456
4,500,386 2/1985 Hoffman ..... 156/568
4,724,029 2/1988 Kontz ..... 156/568
4,729,811 3/1988 DiFrank ..... 156/456

*Primary Examiner*—Michael Wityshyn
*Attorney, Agent, or Firm*—Flehr, Hohbach, Test, Albritton & Herbert

[57] ABSTRACT

A labeling machine employing a turrent with pairs of axially aligned chucks which are rotatable about their common axis, means to move each pair of chucks farther apart for entry and exit of containers; such machine also having a vacuum drum rotatable about an axis parallel to the turret axis and a roll on pad spaced from and concentric to the vacuum drum to confine each container released by the turret and to roll each container on the cylinder surface of the vacuum drum. The roll on pad may have a rearward (downstream) extension to contact the container and rotate them.

1 Claim, 2 Drawing Sheets

LABELING MACHINE COMBINING A TURRET AND A VACUUM DRUM-ROLL ON PAD

FIELD OF THE INVENTION

This invention relates to a labeling machine which employs a turret type of container feed such as described in U.S. Pat. No. 4,108,709 with a vacuum drum having a concentric pad to hold each container with a label attached between the pad and the drum as in U.S. Pat. No. 4,500,386.

BACKGROUND OF THE INVENTION

Each of the labeling machines described in the foregoing U.S. patents has certain advantages. For example, the turret type of labeling machine of the '709 Patent has the advantages of a high speed and of placing the containers close together without the label of one container interfering with the label being applied to the next container. The machine of the '386 Patent has the advantage, among others, of a simple and inexpensive design.

SUMMARY OF THE INVENTION

It is an object of the present invention to provide a labeling machine which combines the advantages of the machine of both the '709 and '386 Patents.

Certain embodiments of the invention are illustrated by way of example in the accompanying drawings, in which:

DETAILED DESCRIPTION OF THE INVENTION

Figure 1:
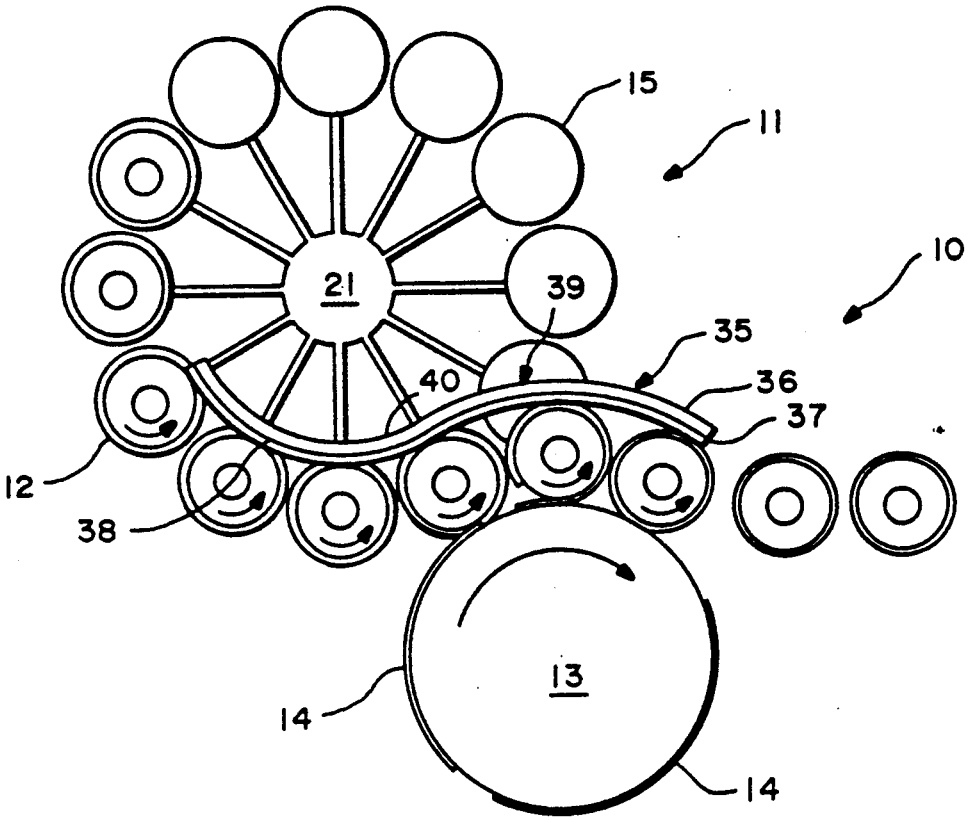
FIG. 1 is a view from above of one embodiment of the invention.

Referring now to FIG. 1, a labeling machine is shown which is designated generally by the reference numeral 10 and it comprises a turret 11 for moving containers 12. A vacuum drum 13 is supplied with labels 14. The label may be severed from a continuously moving strip of label material pulled from a roll or the labels may be pre-cut and extracted one by one from a stack. Suitable label supply means are well known in the art, being shown, for example, in U.S. Pat. No. 4,108,710. Glue may be applied by appropriate means to the leading end and the trailing end of each label or a solvent may be employed to soften the label material at the leading end and/or the trailing end to form an adhesive in situ or a mix of such means may be employed. Heat may be applied to the leading end and/or on the trailing end of the label to soften it and the softened label material may be welded by pressure on the overlapping ends of the label to form a seam.

With regard to the turret 11, pairs of axially aligned chucks are employed, one of each pair being above the other. The upper chucks 15 are shown in FIG. 1.

Figure 3:
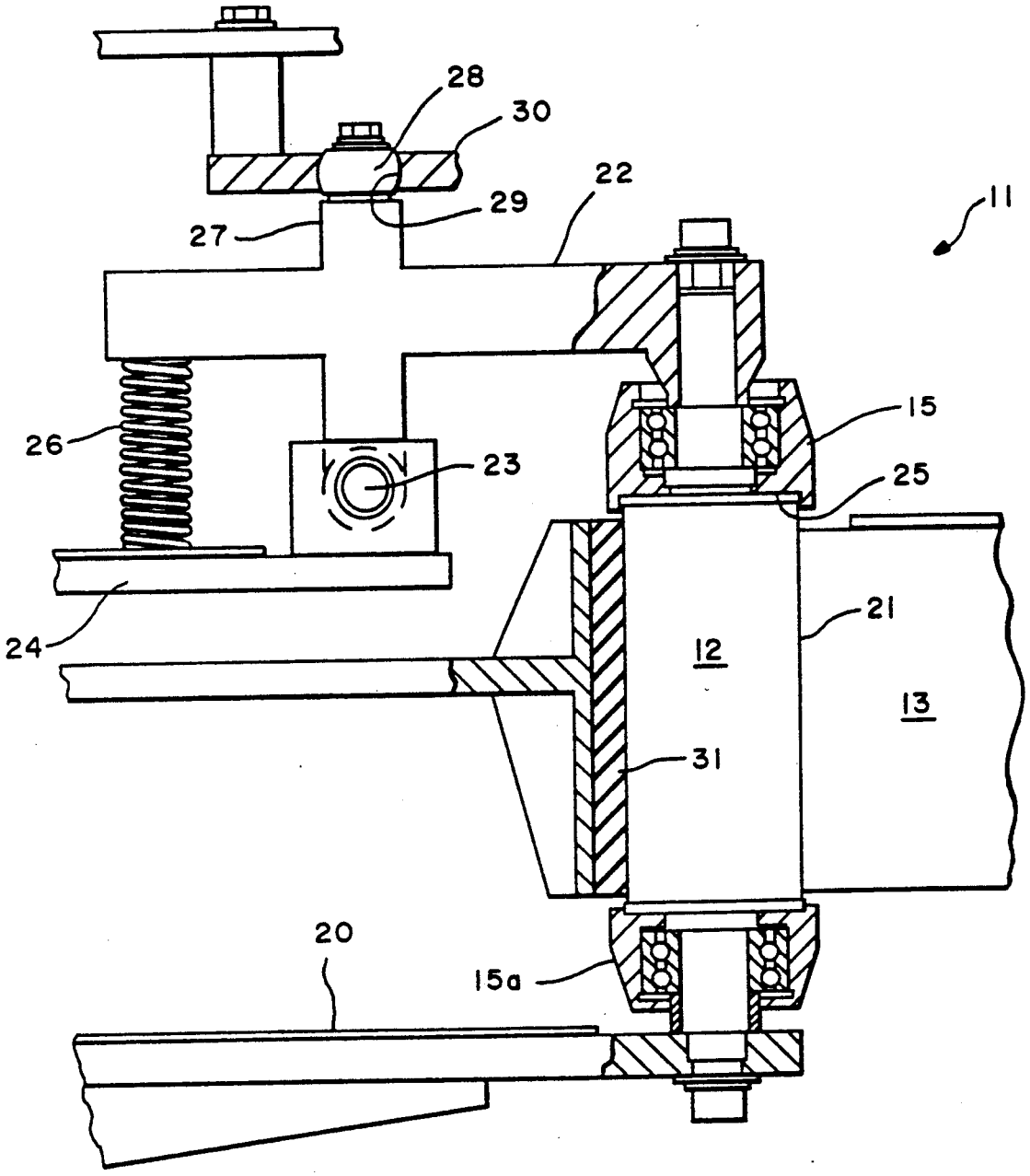
FIG. 3 is a fragmentary view in vertical section taken along the line 3—3 of FIG. 1.

Referring to FIG. 3, which is a simplified version of FIG. 3 of U.S. Pat. No. 4,108,709 with parts omitted, a portion of the turret 11 and of the vacuum drum 13 are shown. One of the upper chucks 15 is shown which is in axial alignment with a lower chuck 15*a* supported on a spoke 20 which in turn is fixed to and rotates with the shaft 21 (see FIG. 1) of the turret. The upper surface of the chuck 15*a* is smooth as shown. The chuck 15*a* is rotatable but is not directly driven.

The upper chuck 15 is supported by a bracket 22 which is pivotally supported at 23 on a frame bracket 24. The chuck 15 is cupped at 25 to receive the upper end of the container and center it and it is rotatable in the outer end of bracket 22. The bracket 22 is urged in clockwise direction as viewed in FIG. 3 by a spring 26 to hold the container 12 in the position shown. The bracket 22 has an extension 27 which carries a cam follower roller 28 which is rotatable and is confined in a cam track 29 in a cam 30 which is fixed to the frame of the turret.

The cam track 29 is such that as the turret 11 rotates in counterclockwise direction as viewed in FIG. 1 the chuck 12 is held up to allow entry of a container; it is then moved down to clamp the container in the position shown in FIG. 3; and it is then moved up to allow exit of the container from the turret. The container is caused to slide across a deadplate (not shown) by means which are described below.

A pad 31 supported on the frame of the turret 11 is outwardly convex and bears against each container 12 to spin it about its axis as it moves with the chucks 15 and 15*a*.

Referring again to FIG. 1 as well as FIG. 3, an S-shaped pad 35 is provided by a plate 36 and a somewhat resilient covering 37. The pad 35 has a first segment 38 which is concentric to the turret 11 and a second segment 39 which is concentric to the vacuum drum 13, and it has an inflection point 40 at the junction of the segment portions 38 and 39.

The segment 38 is supported on the shaft 21 and the frame of the machine by suitable means which holds it stationary and the segment 39 is supported by suitable means (not shown) which holds it stationary. The mounting of the pad 35 may employ means (not shown) which allow shifting circumferentially with respect to the turret and the vacuum drum to allow adjustments and also to allow adjustment radially with respect to the turret and the vacuum drum also for purposes of adjustment. Also the mounting may be such as to permit replacement of one such pad by another, for example to accommodate containers of different diameters and/or heights.

It will be understood that although the pad 35 is shown as an integral continuous pad it may be made in two parts with their ends close together.

Referring to FIG. 1 and FIG. 3, as the turret 11 rotates each container 12 will move orbitally about the axis of the turret; it will be given a spinning motion by reason of its contact with the pad 31 (see FIG. 3); and this spinning motion will be augmented by contact with the segment 38 of pad 35. At the inflection point 40 the upper chuck 15 is lifted by cam 29 and the container 12 slides across a deadplate (not shown) and is guided by segment 39 of pad 35 into contact with vacuum drum 13. The container 12 picks up a label which is released by the vacuum drum and the container with label attached is caused to spin as it moves with the vacuum drum.

The transition of the container 12 from the turret 11 to the vacuum drum 13 is smooth, there being no abrupt transition as there would be if, instead of a turret, a star wheel container feed were used.

By the time a container has reached the end of the pad 35 the label is completely, or at least it is sufficiently wrapped around the container that flagging of a loose end is not a problem.

Moreover, the rate of spin of the container is under control and the spin and translatory motions of the container are both under control.

Such controls are important. For example containers may be of easily deformable material such as plastic, e.g. PET (polyethyleneterephthalate) containers or they may be rigid such as glass containers. Containers may be wet or dry, hot or cool, the speed of translatory and spin motion are variable from case to case, etc. By means of the machine of FIG. 1 the motions of the containers may be controlled to best advantage.

It will be understood that a suitable container infeed, for example a star wheel such as shown in FIG. 1 of U.S. Pat. No. 4,108,709, will be provided, also a suitable labeled container outfeed, for example a roll down belt, will be provided.

Figure 2:
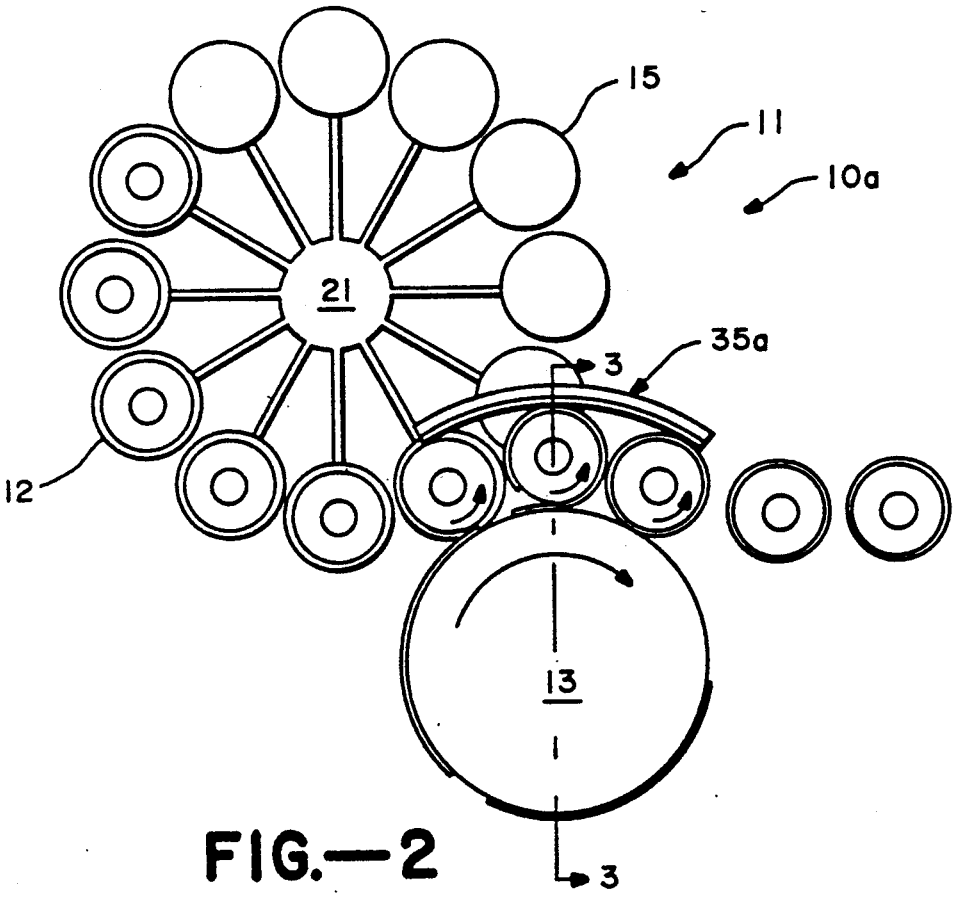
FIG. 2 is a view from above of another embodiment of the invention.

Referring now to FIG. 2, a labeling machine 10A is shown which may be identical with that of FIGS. 1 and 3 but in which the pad 35*a* is shorter than the pad 35 of FIG. 1, is concentric to the vacuum drum 13 and commences at the point of transition of containers 12 from the turret 11 to the vacuum drum 13.

The embodiment of FIG. 1 is preferred because it provides a greater degree of control.

It will therefore be apparent that a labeling machine has been provided which, among other things, provides the speed and compactness of a turret machine with the simplicity and other advantages of a vacuum drum-roll on pad machine.

We claim:

1. A machine for applying segments of sheet material such as labels to the cylindrical surfaces of cylindrical articles each of which has an upper end, a lower end and a cylinder axis extending between said ends, said machine comprising:

(a) a turret having a turret axis and a plurality of pairs of chucks mounted for rotation about said turret axis, said paris being spaced apart angularly about said turret axis and each pair comprising an upper chuck and a lower chuck aligned with the upper chuck, the chucks of each pair being mounted for spinning about a chuck axis parallel to said turret axis and for clamping a cylindrical article by its upper and lower ends and being also mounted so that at least one chuck of each pair may be moved along said chuck axis toward the other chuck of the pair to an article clamping position and away from such other chuck to an article release position, (b) means for rotating the turret and with it said pairs of chucks about said turret axis, (c) means for causing, during such turret rotation, the chucks of each pair to assume their clamping position at an article receiving station, to maintain such clamping position during rotation of the turret until reaching an article release station and then causing the chucks of each pair to assume their article release position, (d) means for causing each pair of chucks, and with them a clamped article, to spin during rotation from the article receiving station to the article release station, (e) a rotary cylindrical vacuum drum mounted for rotation about its cylinder axis parallel to said turret axis and capable of receiving a segment of sheet material on its cylinder surface at a segment receiving station, holding such segment on its cylinder surface by vacuum, transporting the segment so held and releasing it at said article release station, and (f) a stationary pad which is concentric to the vacuum drum cylinder axis and is so mounted and shaped that it will contact articles released by the turret at said article release station, will hold each article so released against the cylinder surface of the vacuum drum and will cause each article, in turn, with a segment applied thereto to spin about its cylinder axis to wrap the segment about such cylinder surface, said stationary pad having an extension which is concentric to the turret axis and which contacts the cylindrical surfaces of the cylindrical articles on their inner sides in relation to the turret axis and assists them to spin about their cylinder axes while being transported by the turret to the article release station.

* * * * *